United States Patent [19]

Tsukamoto

[11] 4,313,040

[45] Jan. 26, 1982

[54] ELECTRO-ACOUSTIC TRANSDUCER WITH FREE EDGE DIAPHRAGM

[76] Inventor: Kenkichi Tsukamoto, Kyoto, Japan

[21] Appl. No.: 146,899

[22] Filed: May 5, 1980

[30] Foreign Application Priority Data

May 15, 1979 [JP] Japan ..... 54-59408

[51] Int. Cl.[3] ..... H04R 9/00

[52] U.S. Cl. ..... 179/115.5 R; 179/115.5 R; 179/181 R

[58] Field of Search ..... 179/115.5 R, 115.5 ES, 179/115.5 VC, 181 R, 181 F; 181/157–174

[56] References Cited

U.S. PATENT DOCUMENTS 1,656,579 1/1928 Farrand et al. ..... 181/163
1,733,013 10/1929 Hibacsko ..... 181/163
1,738,575 12/1929 Greswold ..... 181/171
4,122,314 10/1978 Matsuda et al. ..... 179/115.5 R
4,239,090 12/1980 Dahlquist ..... 179/115.5 VC

FOREIGN PATENT DOCUMENTS 5037 10/1979 European Pat. Off. ..... 179/115.5 R

*Primary Examiner*—George G. Stellar
*Attorney, Agent, or Firm*—Ladas & Parry

[57] ABSTRACT

In a loudspeaker, a suitably formed edge part is provided around the periphery of the diaphragm to form a certain gap between the edge part and an edge receiving part which has an annular recess corresponding to the configuration of the edge part, so that the pressure gradient in the gap is in balance with the surrounding pressure gradient, with the result that the air going in and out of the gap can be substantially neglected.

7 Claims, 5 Drawing Figures

ELECTRO-ACOUSTIC TRANSDUCER WITH FREE EDGE DIAPHRAGM

BACKGROUND OF THE INVENTION

This invention relates to acoustic conversion devices and, more particularly, to a so-called "edgeless acoustic conversion device" in which no material is used to support its diaphragm.

An ordinary acoustic conversion device such as for instance a loudspeaker has an edge which is made of a material such as paper, cloth or synthetic material which may be the same as or different from the material of its diaphragm, in order to support the latter. However, such an edge material has its own characteristic, and therefore the characteristic of reproduction of a loudspeaker using an edge made of the edge material is affected by the characteristic peculiar to the edge material. This is undoubtedly undesirable.

As the amount of absorption loss of the edge is considerably large, the provision of the edge using such a material is undesirable in order to reproduce the variations of an input signal with high fidelity. That is, for this purpose, a so-called "edgeless acoustic conversion device" which is operated through air is suitable.

This kind of loudspeaker is known as the edgeless acoustic speaker. The edge portion of the loudspeaker is as shown in FIG. 1. The diaphragm 10 of the loudspeaker comprises: a cone part 10*a* whose configuration is conical; and a peripheral part 10*b* forming a predetermined angle $\alpha$ with the cone part 10*a*. The frame 11 of the loudspeaker is confronted with the peripheral part 10*b* is such a manner that there is a certain gap 12 between the frame 11 and the peripheral part 10*b*. The gap 12 is acted as a so-called "acoustic low-pass filter." The function of the gap 12 is similar to that of the duct of a bass reflex type loudspeaker. That is, the gap 12 is adapted to positively facilitate the flow of air caused by the vibration of the diaphragm 10, thereby to decrease the lowest resonance frequency of the loudspeaker.

In the case where the conventional loudspeaker thus constructed is used with a bass reflex type loudspeaker box, the acoustic impedance of the gap can be neglected when compared with that of the duct, and therefore the flow of air around the edge can be disregarded.

However, when the conventional loudspeaker is mounted on a closed box, the gap acts similarly as in the duct of the bass reflex type loudspeaker as described above. This is not proper in the case where it is not positively intended to allow the flow of air in the gap. This difficulty attributes to the fact that the conventional edgeless type loudspeaker is different from an ordinary loudspeaker which is so modified that its edge is supported by air resistance; that is, its support is effected only by the damper.

SUMMARY OF THE INVENTION

In view of the foregoing, an object of this invention is to provide an acoustic conversion device which employs an edgeless system merely to eliminate the aforementioned absorption loss due to the use of a material, and which functions equally with a closed box and with a bass reflex type loudspeaker box.

The foregoing object and other objects of the invention have been achieved by the provision of an acoustic conversion device which, according to the invention, comprises: a diaphragm; a voice coil for driving the diaphragm; an edge part which is inclined substantially symmetrically with respect to a phantom plane perpendicular to the direction of motion of the voice coil, the edge part being coupled to the periphery of the diaphragm; and an edge receiving part having a recess substantially complementary in configuration to the edge part, thus forming a predetermined gap between the edge part and the edge receiving part.

The nature, principle and utility of the invention will become more apparent from the following detailed description when read in conjunction with the accompanying drawings.

DETAILED DESCRIPTION OF THE INVENTION

Figure 1:
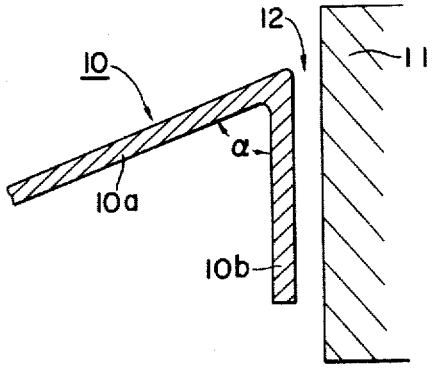
FIG. 1 PRIOR ART
FIG. 1 is an explanatory diagram showing the edge of a conventional loudspeaker.
Figure 2:
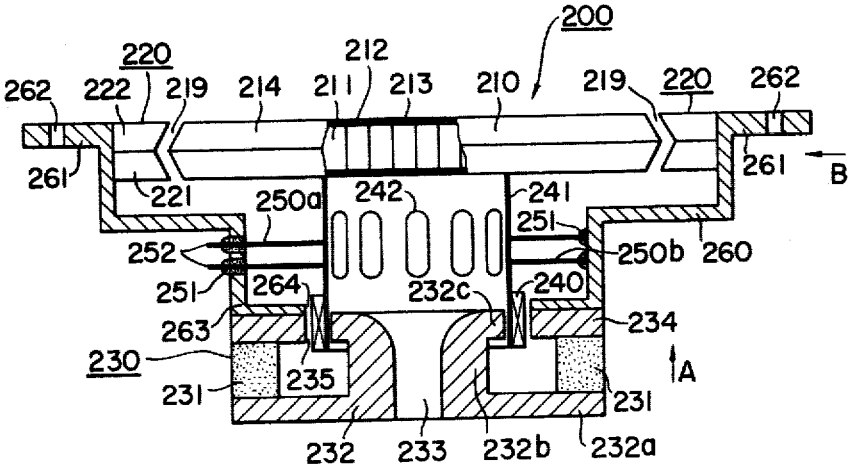
FIG. 2 is a side view, partly as a sectional view, showing a loudspeaker which is one embodiment of this invention.

A loudspeaker 200 which is one embodiment of this invention, as shown in FIG. 2, comprises: a diaphragm 210; an edge receiving part 220; a voice coil 240; a magnetic circuit 230; damper means 250*a* and 250*b*; and a frame 260.

The diaphragm 210 is a planar diaphragm having a honey-comb structure, for instance. More specifically, the diaphragm 210 is made up of a honey-comb core 211, a skin 212 such as an aluminum foil affixed on the honey-comb core 211, and a porous sheet 213 affixed on the skin 212, the porous sheet 213 being impregnated with a damping agent.

Provided around the peripheral portion of the diaphragm 210 thus constructed is a so-called "edge part 214". The edge part is inclined symmetrically with respect to a phantom plane (vertical to the surface of the drawing including the arrow B) which is perpendicular to the direction A of movement of the voice coil 240. The edge part 214 may be formed by winding around the peripheral portion 214 of the diaphragm 210 a sheet of planar tape which has been folded along its center line, or it may be formed by extending and folding the skin 212 and/or the sheet 213. Alternatively, the edge part 214 may be formed by winding a member molded triangular in section around the peripheral portion of the diaphragm.

Figure 3:
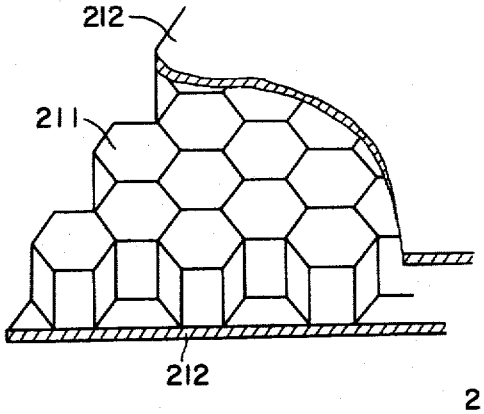
FIG. 3 and FIG. 4 are explanatory diagrams showing examples of the diaphragm of the loudspeaker shown in FIG. 2.
Figure 4:
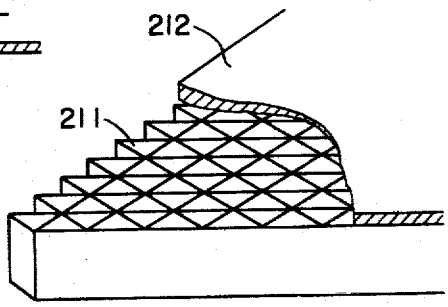

Examples of the honey-comb structure are as shown in FIGS. 3 and 4.

In the example shown in FIG. 3, both sides of a honey-comb core 211 constituted by a number of hexagonal honey-comb core units arranged in one plane are covered with skins 212, respectively. In the example shown in FIG. 4, a honey-comb core 211 is constituted by a number of triangular honey-comb core units arranged in one plane, and only the upper surface of the honey-comb core 211 is covered with a skin 212.

The diaphragm 210 thus constructed is arranged so as to confront through a gap 219 with the edge receiving part 220. The edge receiving part 220 is a ring-shaped member which has an annular recess complementary in configuration to the edge part 214. That is, the edge receiving part 220 is made up of a lower ring 221 and an upper ring 222. The edge receiving part 220 is mounted on the frame 260 as follows: First, the lower ring 221 is fixedly secured to the frame 260, and the diaphragm 210 is arranged in place. Then, the upper ring 222 is fixedly secured to the lower ring 221 and the frame 260. Accordingly, the diaphragm 210 is movable over the stroke which is defined by the angle of inclination of the edge part 214 and the edge receiving part 220 and the dimension of the gap 219.

The edge receiving part 220 may be made of any material such as for instance plastic or metal.

The frame 260 to which the edge receiving part 220 has been fixedly secured has a flange 261 which has several through-holes 262 as shown in FIG. 2. The through-holes 262 are used to fixedly secure the loudspeaker 200 to a baffle board (not shown). Similarly as in conventional frames, the frame 260 has openings to reduce its weight and to allow air to freely flow therethrough. The frame 260 has an opening 264 in the bottom 263 through which the frame 260 is secured to the magnetic circuit 230.

The magnetic circuit 230 is constituted by an annular permanent magnet 231, a first yoke 232 supporting the magnet 231, and a second yoke 234 which is annular and is disposed on the magnet 231. The first yoke 232, as shown in FIG. 2, has a flat bottom **232*a* and a cylindrical protrusion 232*b* extended toward the diaphragm from the central portion of the flat bottom 232*a*. The cylindrical protrusion 232*b* has a throughhole 233 along its axis in such a manner that it is diverged, in the form of a funnel, inwardly of the loudspeaker. The innermost end portion of the cylindrical protrusion 232*b* is in the form of a flange, thus forming a magnetic gap 235 with the second annular yoke 234. The frame 260 is fixedly secured to the second yoke 234**.

The voice coil 240 is wound on one end portion of a coil bobbin 241. The voice coil 240 is inserted into the magnetic gap 235 thus formed. The coil bobbin 241 has a number of openings 242 to reduce its weight and to allow air to freely pass therethrough. The other end portion of the coil bobbin 241 is secured to the diaphragm 210.

The supporting means **250*a* and 250*b* are provided at the middle portion of the coil bobbin 241. The supporting means 250*a* and 250*b*** are made of a material such as a thin copper plate which is extremely small in mechanical hysteresis and mechanical absorption loss. The coil bobbin is so designed that the number of its supporting points is a prime number (a damper of this type being disclosed by the specification of Japanese Patent Application Laid-Open No. 113523/1978 in detail). In this connection, it should be noted that most of conventional dampers are extremely large in loss.

The supporting means **250*a* and 250*b* are fixedly secured to the frame 260 through insulating members, and the rest position of the diaphragm 210 depends on the selection of the positions at which the supporting means are fixed. Since the supporting means 250*a* and 250*b* are arranged as described above, the supporting means can be used as lead conductors for the voice coil 240; that is, the supporting means can be connected through terminals 252**, for instance, to an amplifier (not shown).

Figure 5:
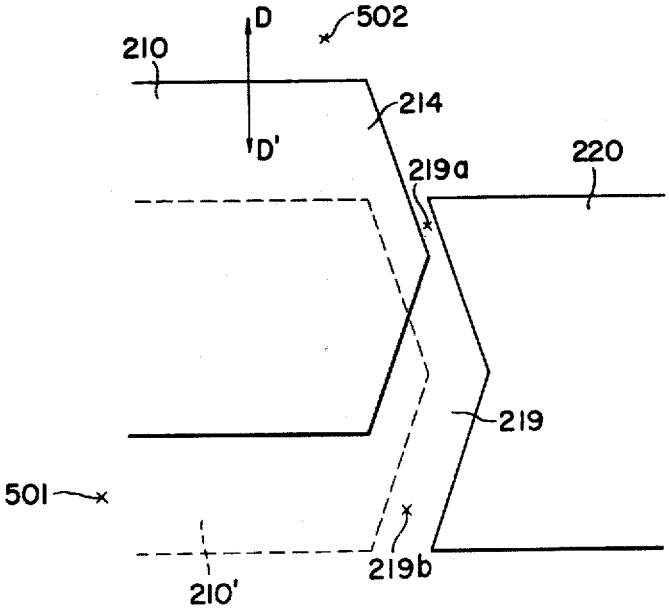
FIG. 5 is a diagram for a description of the operation of the loudspeaker according to the invention.

The operation of the loudspeaker thus constructed will be described, with reference to FIG. 5. FIG. 5 shows the diaphragm 210 and the edge receiving part 220 in the above-described embodiment. In FIG. 5, the diaphragm (210') indicated by the dotted line is at rest.

It is assumed that current flows in the voice coil of the loudspeaker arranged in a closed box, to move the diaphragm 210 forwardly as indicated by the arrow D. In this case, as is clear from FIG. 5, at the point **219*a* the gap 219 between the edge part 214 and the edge receiving part 220 is reduced, when compared with that provided when the diaphragm is at rest, and accordingly the air pressure there is increased. On the other hand, at the point 219*b* the gap 219 is increased, when compared with that provided when the diaphragm is at rest, and accordingly the air pressure there is decreased. It goes without saying that, in this operation, the air pressure on the front surface 502 of the diaphragm 210 is increased, while the air pressure on the rear surface 501** is decreased.

In this connection, if the gap 219 is decreased to a certain extent or more, then the pressure gradient of the point **219*a* to the point 219*b* can be made much larger than the pressure gradient of the point 219*a* to the front surface 502. In this case, a larger part of the air in the gap 219 is allowed to flow inwardly, but the air in the gap 219** scarcely flows outwardly.

When the diaphragm 21 is moved backwardly as indicated by the arrow D', the air pressure at the point **219*b* is increased, while the air pressure at the point 219*a* is decreased. In this case, the air pressure on the front surface 502 of the diaphragm is decreased, while the air pressure on the rear surface 501 is increased. Accordingly, the air in the gap 219 is allowed to flow from the point 219*b* to the point 219*a*. In this case, the outside air tends to flow to the point 219*a*; however, if the pressures are suitably in balance, the outside air scarcely flows into the air gap 219**.

As is clear from the above description, the pressure gradient in the gap 219 is suitably in balance with the surrounding pressure gradient, and therefore the air going in and out of the gap 219 can be substantially neglected; that is, the diaphragm operates as if it were supported by the air.

While the invention has been described with reference to the loudspeaker which has the planar diaphrgam having the honey-comb structure, it is obvious that the technical concept of the invention can be applied to cone-type loudspeakers having honey-comb structures or not having honey-comb structures or other loudspeakers.

Furthermore, it can be readily understood that the structural feature of the invention can be directly applied to other acoustic conversion devices such as headphones and microphones.

As is apparent from the above description, the acoustic conversion device in which the loss due to the edge effect is minimized, whereby the response to variations of signals is high and reproduction can be performed with high fidelity, can be provided according to the invention.

What is claimed is:

1. An acoustic conversion device comprising:

a planar diaphragm which is formed by affixing a porous sheet impregnated with a damping agent on a honey-comb core constituted by honey-comb core units arranged in one plane;

a voice coil for driving said diaphragm;

an edge part which is inclined substantially symmetrically with respect to a phantom plane perpendicular to the direction of motion of said voice coil, said edge part being coupled to the periphery of said diaphragm; and an edge receiving part having a recess substantially complementary in configuration to said edge part, thus forming a predetermined gap between said edge part and said edge receiving part.

2. A device as claimed in claim 1, in which the lead wires of said voice coil serve as supporting members also.

3. A device as claimed in claim 2, in which said lead wires are made of an electrically conductive material which is extremely small in mechanical hysterisis and mechanical absorption loss.

4. An acoustic conversion device comprising:

a diaphragm;

a voice coil for driving said diaphragm;

an annular edge part connected to and surrounding the periphery of said diaphragm, said edge part having an outer surface configuration defined by a pair of frusto-conical surfaces joined together at corresponding diameters thereof in a plane of symmetry perpendicular to the direction of motion of said voice coil;

and an edge receiving part having an annular recess substantially complementary in configuration to said edge part, thus forming between said edge part and said edge receiving part at the rest position of said diaphragm a predetermined gap whose size changes with movement of said voice coil in its said direction of motion.

5. A device according to claim 4, in which said diaphragm is a planar diaphragm having a honey-comb structure, at least the remote side of which relative to said voice coil is provided with a foil skin on which is affixed a porous sheet impregnated with a damping agent.

6. A device according to claim 4, in which the lead wires of said voice coil serve as supporting members also.

7. A device according to claim 6, in which said lead wires are made of an electrically conductive material which is extremely small in mechanical hysterisis and mechanical absorption loss.

* * * * *